US006796509B1

(12) United States Patent
Webster et al.

(10) Patent No.: US 6,796,509 B1
(45) Date of Patent: Sep. 28, 2004

(54) MODEL TOY TRAIN TRACK

(75) Inventors: Richard Webster, New Baltimore, MI (US); Katherine Bis, Northville, MI (US)

(73) Assignee: Lionel L.L.C., Chesterfield, MI (US)

( * ) Notice: Subject to any disclaimer, the term of this patent is extended or adjusted under 35 U.S.C. 154(b) by 0 days.

(21) Appl. No.: 10/342,511

(22) Filed: Jan. 15, 2003

(51) Int. Cl.[7] ..... E01B 23/00
(52) U.S. Cl. ..... 238/10 E; 104/DIG. 1
(58) Field of Search ..... 238/10 R, 10 A, 238/10 B, 10 C, 10 E, 10 F, 2, 14.05, 14.3; 104/DIG. 1

(56) References Cited

U.S. PATENT DOCUMENTS

| | | | | | |
|---|---|---|---|---|---|
| 1,467,475 | A | * | 9/1923 | Egolf | 238/10 B |
| 2,021,514 | A | * | 11/1935 | Martin | 238/10 R |
| 2,265,965 | A | * | 12/1941 | Frisbie | 238/10 R |
| 2,673,689 | A | | 3/1954 | Bonanno | |
| 2,871,308 | A | | 1/1959 | Pettit | |
| 3,074,647 | A | | 1/1963 | Bonanno | |
| 4,231,517 | A | | 11/1980 | Cheng | |
| 4,709,856 | A | | 12/1987 | Rother et al. | |
| 4,953,785 | A | | 9/1990 | Keska | |
| 5,299,735 | A | * | 4/1994 | Thomas | 238/10 B |
| 5,503,330 | A | | 4/1996 | Riley | |
| 5,690,278 | A | | 11/1997 | Grubb | |
| D421,281 | S | | 2/2000 | Riley | |
| 6,019,289 | A | * | 2/2000 | Sung | 238/10 E |
| 6,398,120 | B1 | * | 6/2002 | Klein | 238/10 B |

OTHER PUBLICATIONS

Marklin HO Brochure: "With a 'Click' into the new millennium. C Track" 1996 E.
Lionel Brochure: "Lionel Trutrack System".

* cited by examiner

*Primary Examiner*—S. Joseph Morano
*Assistant Examiner*—Robert J. McCarry, Jr.
(74) *Attorney, Agent, or Firm*—Dykema Gossett PLLC

(57) ABSTRACT

A rail system for a toy train having at least one elongate rail with a hollow cross-section having a surface defining a connection portion along at least part of the outer periphery of the rail. The hollow rails are reinforced with at least one rib molded into the track bed. Each end of the elongate outer rails is either preassembled with corresponding pin or adaptable for receiving a pin preassembled in an adjacent track segment. An intermediate pin is operably engaged with each end of an intermediate rail and is slidingly engagable with a corresponding intermediate pin located in an adjacent intermediate rail connected to an adjacent intermediate track segment. The connection portion of each pin extends beyond the end of the rail for operable engagement with the corresponding connection portion of an adjacent rail communication electrically with the adjacent rails on an adjacent track segment.

20 Claims, 4 Drawing Sheets

35
33
28
31
58

35
26
58

12'
16'
10'
14'
28'
33'
26'
18'
10
26
24
33
28
22
34
18
12
16
14
36

MODEL TOY TRAIN TRACK

FIELD OF THE INVENTION

The invention relates to a model railroad track.

BACKGROUND OF THE INVENTION

Model train railroad tracks with roadbeds are known in the toy train industry. See U.S. Pat. No. 6,019,289. Prior art tracks are often too expensive. A need exists for a comparatively inexpensive model toy train and roadbed with durable connectors.

SUMMARY OF THE INVENTION

The present invention preferably provides a track for a toy train wherein the track includes a plurality of track segments. Each track segment includes an elongate roadbed having first and second ends. First and second elongate outer rail segments are connected to the roadbed. Each outer rail segment has a substantially U-shaped hollow cross-section, a substantially flat top surface, and first and second ends that are proximate to the first and second ends of the roadbed, respectively. Each track segment has an elongate intermediate rail segment interposed between the first and second outer rail segments. The intermediate rail segment also has a substantially U-shaped hollow cross-section with a substantially flat top surface. The first and second ends of the intermediate rail segment coincide with the first and second ends of the roadbed.

A first outer pin is engaged with the first end of the first outer rail and the second end of that rail is adaptable for receiving an outer pin that is preassembled in an adjacent rail segment positioned on an adjacent track segment. The second outer rail has an outer pin preassembled in the second end and the first end is adaptable for receiving an outer pin preassembled in an adjacent rail segment positioned on an adjacent track segment. The intermediate rail has an intermediate pin that is preassembled in both the first and second ends. Each intermediate rail end is adaptable for receiving a second intermediate pin from an adjacent rail segment The second intermediate pin is slidingly engageable with the preassembled intermediate pin in the original track segment.

The outer pins are preferably rectangular in shape and of substantially similar width as the width of the hollow cavity of the outer rail throughout the entire length of the pin. The intermediate pins have a substantially similar width as the hollow cavity of the intermediate rail along a first portion of the pin, and the width of the pin narrows to substantially half of the width of the rail along a second portion of the pin. This configuration allows each track segment to be preassembled with the pin in predetermined locations such that each track segment can be utilized with curved track segments oriented in either direction without rearranging any of the pins.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
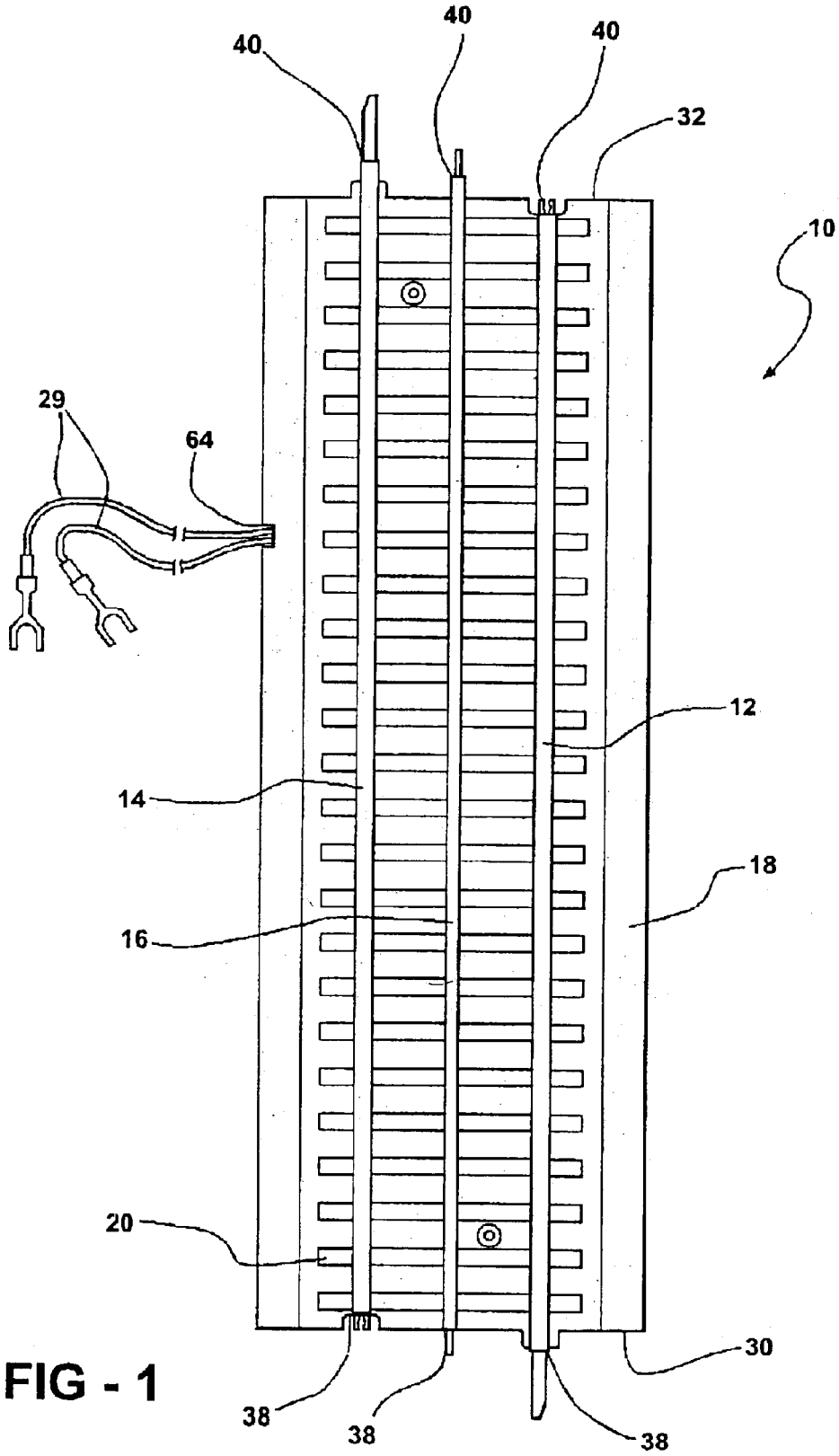
FIG. 1 is a plan top view of a railroad track segment.
Figures 2, 5, 6:
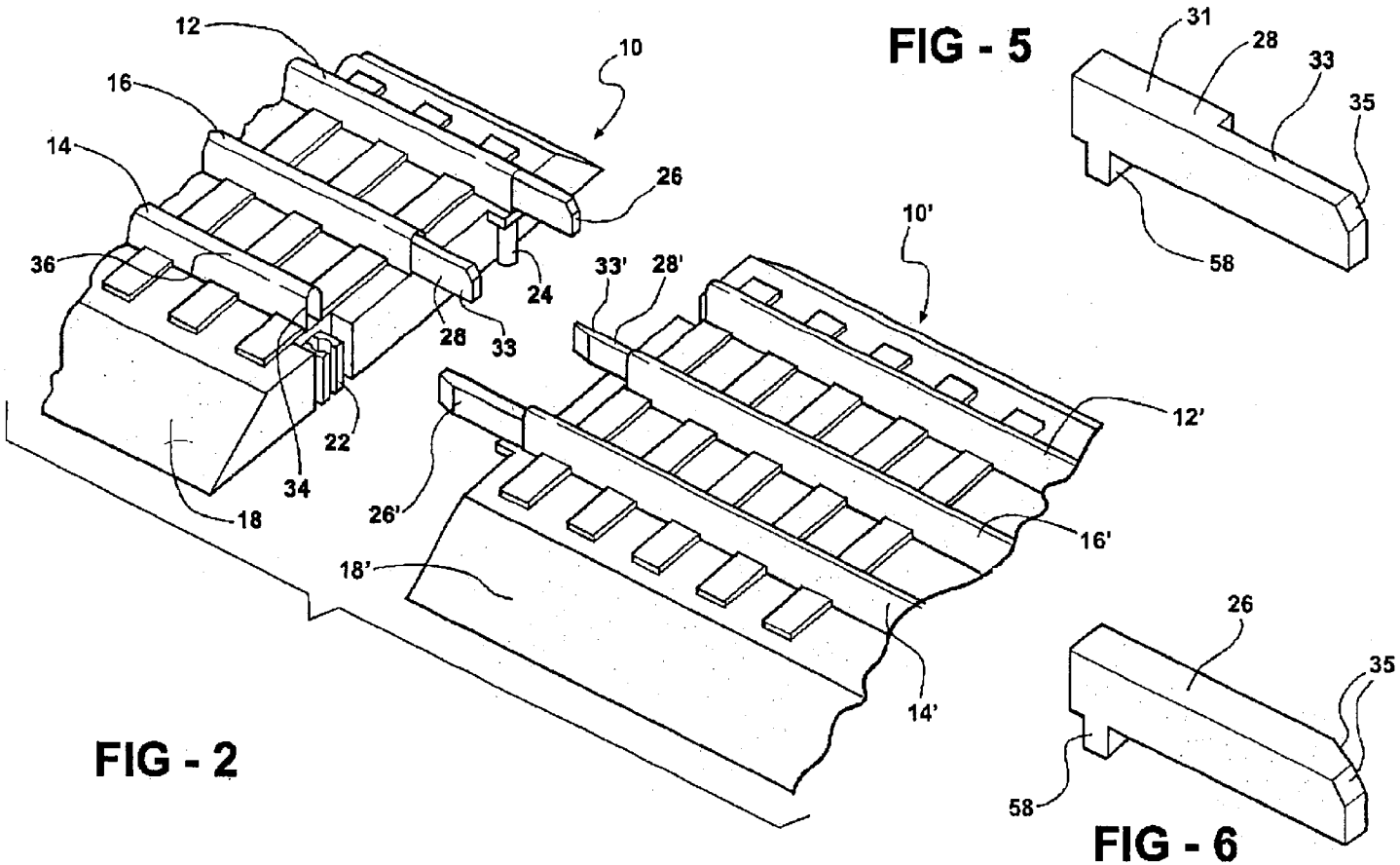
FIG. 2 is a perspective end view of two adjacent track segments.
FIG. 5 is a perspective view of an intermediate pin.
FIG. 6 is a perspective view of an outer pin.

With reference to the figures wherein like elements are numbered alike, there is shown a model toy train track with a roadbed according to the first preferred embodiment of the present invention. With reference to FIGS. 1 and 2, there is shown a track segment 10. Track segment 10 includes two outer rail segments 12, 14, one intermediate rail segment 16, and a roadbed 18. Rail segments 12, 14, 16 are mounted longitudinally on the roadbed 18 in a spaced apart manner such that the wheels (not shown) of the train can run along the outer rail segments 12,14 and a power roller or contact (not shown) can run along the intermediate rail segment 16. Rail segments 12, 14, 16 having first and second ends 38, 40, are positioned on top of the roadbed 18 and are preferably mechanically connected to the roadbed 18. The elongate intermediate rail segment 16 is interposed between the outer rail segments 12, 14. Each of the rail segments 12, 14, 16 have a substantially U-shaped hollow cross-section 34 with a substantially flat surface 36.

A pair of electrical lead wires 29 is shown ingressing through the aperture 64 located on the roadbed 18 for transporting electrical power from an electrical source (not shown) to the rails 12, 14, 16. Roadbed 18 may include a number of cosmetic features, for example, a plurality of ties 20 are positioned longitudinally along the top of each track segment 10. It is understood that these ties are preferably molded into the roadbed 18 to provide a more realistic looking railroad track.

FIG. 2 shows the ends of two track segments 10, 10' as each would appear prior to assembly with one another. Outer pins 26, 26' and intermediate pins 28, 28' are preferably preassembled in each track segment 10, 10' prior to connecting the track segments 10 and 10' together. The outer pins 26, 26' are used to mechanically and electrically connect the outer rail segments 12, 14 together with adjacent outer rail segments 12', 14' that have been assembled to an adjacent track segment 10'. Similarly, the intermediate pins 28, 28' are used to connect intermediate rail segment 16 with adjacent rail segment 16' for establishing a mechanical and an electrical link. The pins 26, 28 are preassembled and oriented with the rail segments 12, 14, 16 in a manner that allows any combination of straight and curved track segments to be assembled together without moving pins around to different locations.

The first outer pin 26 is engaged with the first end 38 of the first outer rail segment 12, and the second end 40 of the first outer rail 12 is adaptable for receiving an outer pin 26' that has been preassembled in an adjacent outer rail segment 12' on an adjacent track segment 10'. The second outer rail 14 has an outer pin 26 preassembled in the second end 40 thereof. The first end 38 of the second outer rail 14 is adaptable for receiving the outer pin 26' that has been preassembled in the adjacent rail segment 10'. The intermediate rail segment 16 has the intermediate pin 28 preassembled in both the first and second ends 38, 40 thereof. Each intermediate rail end 38, 40 is adaptable for receiving a second intermediate pin 28' that has been preassembled in an adjacent rail segment 16'. The second intermediate pins 28' are slidingly engageable with each preassembled intermediate pin 28 in rail segment 16.

Figure 3:
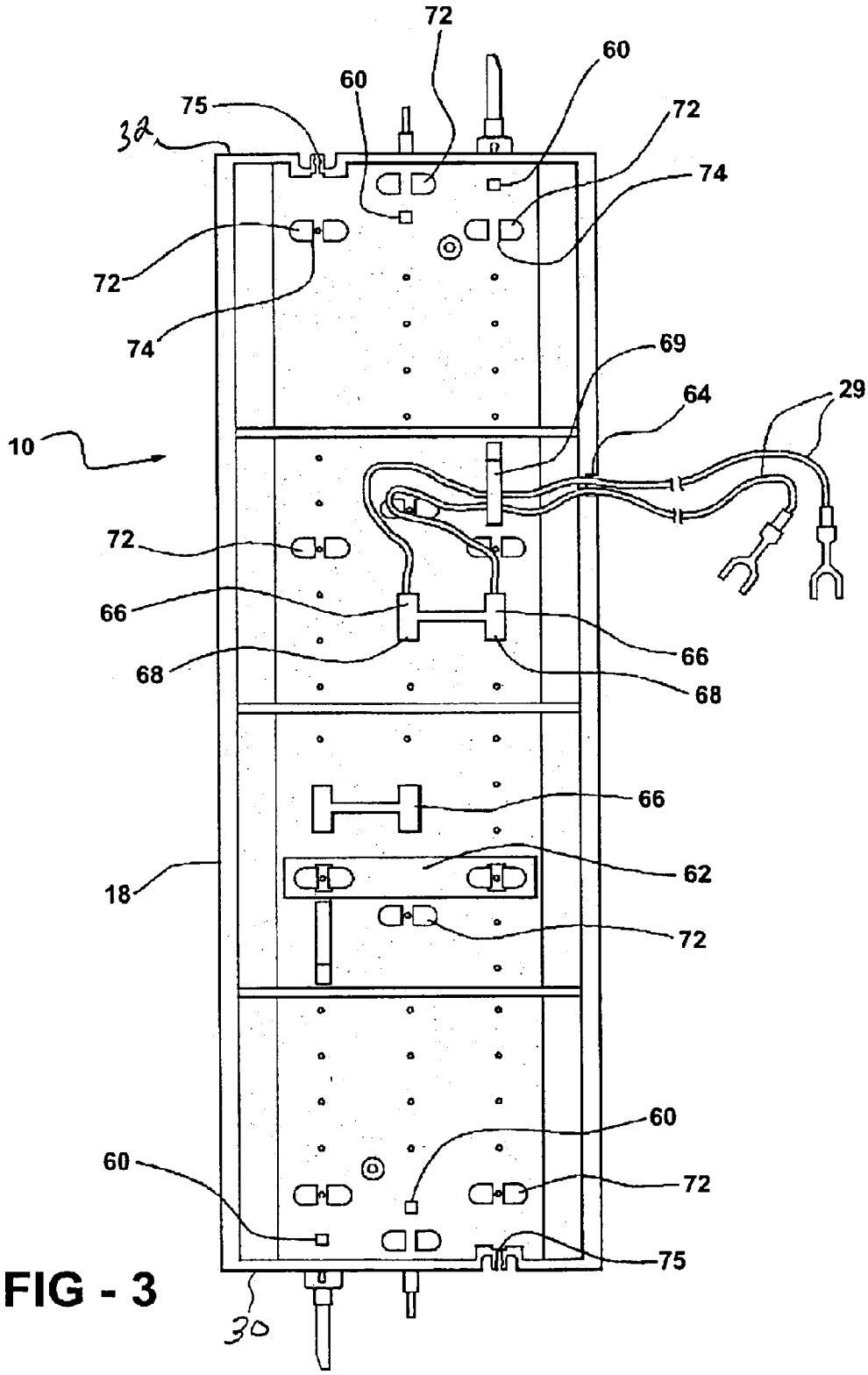
FIG. 3 is a plan underside view of the track segment.

FIG. 3 shows the underside of the roadbed 18. Electric power is delivered to the rails 12, 14 and 16 from the underside of the roadbed 18 with electrical contact wire leads 29. There is at least one aperture 64 located on the side of the roadbed 18 providing access from an electrical power source (not shown) to the track segment 10. A slot 66 is formed in the roadbed 18 to allow electrical communication between the rail segments 12, 14, 16 located on top of the roadbed 18 and the electrical wire leads 29 positioned on the underside of the roadbed 18. Each slot 66 is formed in conjunction with at least one pedestal 68 for holding the wire leads 29 in place on the underside of the roadbed 18. The pedestals 68 along with a second protruding member 69 protect the wire leads 29 from being pinched or inadvertently pulled from their connections to the rail segments 12, 14, 16.

Each rail segment 12, 14, 16 is fixedly held with respect to the roadbed 18 by sliding at least one pair of winged flanges 72, attached to each rail segment 12, 14, 16, through corresponding slots 74 in the roadbed 18. The winged flanges 72 are preferably metallic and are foldable normal to the direction of the slots 74 on the underside of the roadbed 18 to prevent the rail from disengaging from the roadbed 18. If winged flanges 72 are bent in such a way as to become parallel with the slots 74, the flanges will be capable of sliding back through the slots 74 to facilitate removal of the rail segments 12, 14, 16 from the roadbed 18.

A link 62 is positioned on the underside of roadbed 18 on each track segment 10 for electrically connecting each of the outer rail segments 12, 14 together to facilitate electrical communication and grounding between the outer rail segments 12, 14. The link 62, formed of an electrically conductive material, provides the constant ground loop portion of the electric circuit. The links 62 are connected with the winged flanges 72 of the outer rails 12, 14 and are positioned in a similar location on each track segment 10.

Figure 4:
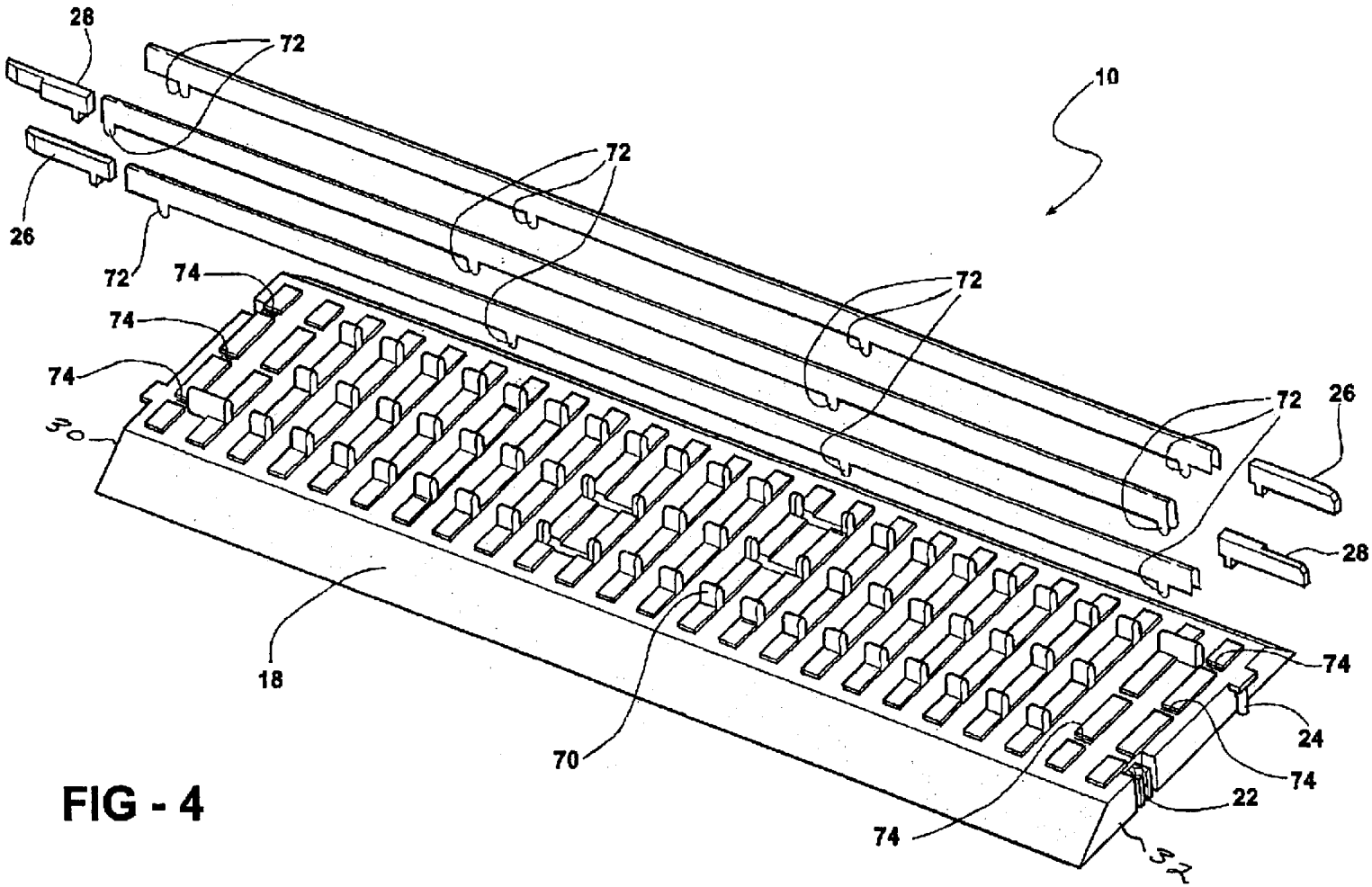
FIG. 4 is a perspective of an exploded view of the track segment.

Referring now to FIG. 4, an exploded view of the track segment 10 is shown with the rail segments 12, 14, 16 removed therefrom. Roadbed 18 is illustrated as including a plurality of ribs 70 extending substantially orthogonally from the top thereof in three rows corresponding to the three rail segments 12, 14, 16. The ribs 70 are shown as a plurality of discreet members in the drawing, but could be formed as one continuous member extending from one end 30 to the other end 32 of the track segment 10. The ribs 70 are used to support the rail segments 12, 14, 16 from loads that may bend the thin metal rail walls. The ribs 70 may prevent the rail segments 12, 14, 16 from easily buckling and breaking. Also, in this view, the winged flanges 72 are shown integrally formed on the rail segments 12, 14, 16 prior to being slid through slots 74 and bent over onto the underside of the roadbed 18.

There is at least one snap fit connection on each track segment end 30, 32. The snap fit connection includes a male member 24 and a complementary female member 22 for snapping together and connecting adjacent track segments 10, 10'. The snap fit connectors 22, 24 are used for removably attaching adjacent track segments 10, 10' with respect to the interlocking portions of the complementary male 24 and female 22 members. The male member 24 is substantially cylindrical in shape and positioned on the end of the roadbed 18 for snap locking into the corresponding female member 22 on an adjacent roadbed segment 18. The female member 22 has a substantially internally reversed pattern relative to the male member 24. A slot 75 is formed through the front and back walls of the female member 22, so that increased deflection can be obtained, thus increasing the durability of the snap connection.

FIGS. 5 and 6 show perspective views of the intermediate pin 28 and the outer pin 26. The pins may be cast from electrically conductive material, such as tin, copper, steel, zinc, etc. The intermediate pin 28 or "half pin" is substantially rectangular in shape having a width substantially the same as the width of the hollow cavity of the intermediate rail 16 along a first portion 31 of the intermediate pin 28. The width 31 of intermediate pin 28 narrows to substantially half of the width of the rail 16 along a second portion 33 of the intermediate pin 28.

Opposing intermediate pin ends 33, 33' as shown in FIG. 2, are positioned so as to be protruding away from opposing intermediate rail segments 16, 16' for slidingly engaging with one another as the track segments 10, 10' are assembled together. The outer pins 26 are substantially rectangular in shape and have substantially constant width throughout the entire length of the outer pin 26. Both the outer pins 26 and the intermediate pins 28 have selectively placed chamfers 35 on the edges thereof for facilitating their slidingly engageable characteristics with respect to an adjacent rail segment 10'. Each of the outer 26 and intermediate 28 pins has a peg 58 protruding substantially orthogonally therefrom. The peg 58 is insertable into an aperture 60 located in the roadbed 18 as shown in FIG. 3. The peg 58 and the aperture are shown with a substantially square cross-section, however, any geometric shape, such as circular, triangular, or rectangular, could be utilized. The aperture 60 for the peg 58 prevents the pins 26, 28 from moving relative to the roadbed 18 in a lateral or longitudinal direction with respect to the roadbed 18. After the rails 12, 14, 16 are assembled and locked into position over the pins 26, 28, the pins 26, 28 are then prevented from moving away from the roadbed 18 in an orthogonal direction as well as in the lateral and longitudinal directions.

As referenced in general above, it is understood that a plurality of track segments 10 may be connected together end to end in various manners to provide a completed track (not shown) for the toy train to run continuously thereon. Referring to FIG. 2, track segment 10 may be assembled with similar track segments 10' in a longitudinally adjacent relationship and mechanically connected with snap fit connections 22, 24. Rail segments 12, 14, 16 are connected to adjoining rail segments 12', 14', 16' on the adjacent track segments 10' with outer pins 26, 26' and an intermediate pin 28, 28' for the outer rails 12, 14 and intermediate rail 16, respectively. The track is not limited to any particular configuration, but may be constructed in any manner according to the operator's desire.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A track segment for a model toy train comprising:

an elongate roadbed having first and second ends;

first and second elongate outer rail segments connected to the roadbed, each outer rail segment having a substantially U-shaped hollow cross section with a substantially flat top surface, each outer rail segment having a first end proximate the first roadbed end and a second end proximate the second roadbed end;

an elongate intermediate rail segment interposed between the first and second outer rail segments and connected to the roadbed, the intermediate rail segment having a substantially U-shaped hollow cross section with a substantially flat top surface, the intermediate rail segment having a first end proximate the first roadbed end and a second end proximate the second roadbed end;

a first outer pin engaged with the first end of the first outer rail, the second end of the first outer rail adaptable for receiving an outer pin preassembled in an adjacent outer rail segment positioned on an adjacent track segment, the second outer rail having an outer pin preassembled in the second end and the first end adaptable for receiving an outer pin preassembled in an adjacent rail segment positioned on an adjacent track segment; and the intermediate rail having an intermediate pin preassembled in both the first and second ends, each intermediate rail end adaptable for receiving a second intermediate pin from an adjacent rail segment, the second intermediate pin being slidingly engageable with the preassembled intermediate pin.

2. The track of claim 1, wherein the intermediate pin is a half pin being substantially rectangular in shape and having a width substantially the same as a width of the hollow cavity of the intermediate rail along a first portion of the half pin and the width of the half pin narrowing to substantially half of the width of the rail along a second portion of the half pin, opposing half pins positioned in opposing intermediate rail segments slidingly engage with one another when the track segments are assembled; and the outer pin being substantially rectangular in shape and of substantially constant width throughout the entire length of the outer pin.

3. The track of claim 1, wherein outer and intermediate pins further comprise:

a peg protruding substantially orthogonally away from each of the pins, the peg being insertable into an aperture located in the roadbed.

4. The track of claim 1, wherein the outer and intermediate pins are cast from an electrically conductive material.

5. The track of claim I further comprising:

a link positioned on an underside of the roadbed and attached to each outer rail for communicating electrical grounding between the outer rails on each track segment, the link forming a constant ground loop portion of an electric circuit.

6. The track of claim 1 further comprising:

at least one aperture located on the side of the roadbed for allowing access to an electrical power source.

7. The track of claim 1 further comprising:

at least one slot formed through the roadbed such that electrical communication with the rails can be implemented with an electrical wire lead from an underside of the roadbed.

8. The track of claim 1 further comprising:

at least one pedestal for holding wire leads in place on the underside of the roadbed.

9. The track of claim 1 further comprising:

at least one rib extending substantially orthogonally from the top of the roadbed in three rows corresponding to the three rail segments for providing support to each rail segment.

10. The track of claim 1 further comprising:

at least one snap fit connector having a male element on one track segment and a female element on an adjacent track segment, the connector used for removably attaching adjacent segments of track with respect to one another by interlocking complimentary male and female elements between adjacent roadbed segments.

11. The track of claim 10, wherein the snap fit connectors further comprise:

the male member being substantially cylindrical in shape and positioned on the end of the roadbed for snap locking into a corresponding female member on an adjacent roadbed segment; and the female member substantially having an internally reverse pattern relative to the male member, the female member having a slot formed through a front and a back wall.

12. The track of claim 1, wherein each outer and intermediate rail is fixedly held with respect to the roadbed by sliding at least one pair of winged flanges attached to each rail through corresponding slots in the roadbed, the wings being foldable normal to the direction of the slots on the underside of the roadbed for preventing the rails from disengaging from the roadbed.

13. The track of claim 1, wherein the outer and intermediate pins have a plurality chamfers formed on the edges thereof.

14. A track segment for a model toy train comprising:

an elongate roadbed having first and second ends;

first and second elongate outer rail segments connected to the roadbed, each outer rail segment having a substantially U-shaped hollow cross section with a substantially flat top surface adaptable for receiving an outer pin for mechanically connecting with and electrically communicating with an adjacent outer rail segment;

an elongate intermediate rail segment interposed between the first and second outer rail segments and connected to the roadbed, the intermediate rail segment having a substantially U-shaped hollow cross section with a substantially flat top surface adaptable for receiving an intermediate pin for mechanically connecting with and electrically communicating with an adjacent intermediate rail segment; and a plurality of ribs extending substantially orthogonally from the top of the roadbed in three rows corresponding to the three rail segments to support each rail segment.

15. The track of claim 14, wherein the intermediate pin is a half pin being substantially rectangular in shape and having a width substantially the same as a width of the hollow cavity of the intermediate rail along a first portion of the half pin and the width of the half pin narrowing to substantially half of the width of the rail along a second portion of the half pin, opposing half pins positioned in opposing intermediate rail segments slidingly engage with one another when the track segments are assembled; and the outer pin being substantially rectangular in shape and of substantially constant width throughout the entire length of the outer pin.

16. The track of claim 14 further comprising:

a link positioned on an underside of the roadbed and attached to each outer rail for communicating electrical grounding between the outer rails on each track segment, the link forming a constant ground loop portion of an electric circuit;

at least one aperture located on the side of the roadbed for allowing access to an electrical power source;

at least one of slot formed through the roadbed such that electrical communication with the rails can be implemented with electrical wire leads from an underside of the roadbed; and at least one pedestal for holding wire leads in place on the underside of the roadbed.

17. A track segment for a model toy train comprising:

an elongate roadbed having first and second ends;

first and second elongate outer rail segments connected to the roadbed, each outer rail segment having a substantially U-shaped hollow cross section with a substantially flat top surface, each outer rail segment having a first end proximate the first roadbed end and a second end proximate the second roadbed end;

an elongate intermediate rail segment interposed between the first and second outer rail segments and connected to the roadbed, the intermediate rail segment having a substantially U-shaped hollow cross section with a substantially flat top surface, the intermediate rail segment having a first end proximate the first roadbed end and a second end proximate the second roadbed end;

a first outer pin engaged with the first end of the first outer rail, the second end of the first outer rail adaptable for receiving an outer pin preassembled in an adjacent outer rail segment positioned on an adjacent track segment;

the second outer rail having an outer pin preassembled in the second end and the first end adaptable for receiving an outer pin preassembled in an adjacent rail segment positioned on an adjacent track segment;

the intermediate rail having an intermediate pin preassembled in both the first and second ends, each intermediate rail end adaptable for receiving a second intermediate pin from an adjacent rail segment, the second intermediate pin being slidingly engagable with the preassembled intermediate pin;

the intermediate pin is a half pin being substantially rectangular in shape and having a width substantially the same as a width of the hollow cavity of the intermediate rail along a first portion of the half pin and the width of the half pin narrowing to substantially half of the width of the hollow cavity of the intermediate rail along a second portion of the half pin, opposing half pins positioned in opposing intermediate rail segments slidingly engage with one another when the track segments are assembled;

the outer pin being substantially rectangular in shape and of substantially constant width throughout the entire length of the outer pin; and a peg protruding substantially orthogonally away from each of the pins, the peg being insertable into an aperture located in the roadbed.

18. The track of claim 17, wherein the outer and intermediate pins are cast from an electrically conductive material.

19. The track of claim 17 further comprising:

a link positioned on an underside of the roadbed and attached to each outer rail for communicating electrical grounding between the outer rails on each track segment, the link forming a constant ground loop portion of an electric circuit; and at least one aperture located on the side of the roadbed for allowing access to an electrical power source.

20. The track of claim 17 further comprising:

at least one slot formed through the roadbed such that electrical communication with the rails can be implemented with electrical wire leads from an underside of the roadbed;

at least one pedestal for holding wire leads in place on the underside of the roadbed; and at least one rib extending substantially orthogonally from the top of the roadbed in three row corresponding to the three rail segments for providing support to each rail segment.

* * * * *

UNITED STATES PATENT AND TRADEMARK OFFICE

CERTIFICATE OF CORRECTION

PATENT NO. : 6,796,509 B1
DATED : September 28, 2004
INVENTOR(S) : Webster et al.

It is certified that error appears in the above-identified patent and that said Letters Patent is hereby corrected as shown below:

Column 5,
Line 42, "I" should be -- 1 --.

Column 6,
Line 23, "chamfers" should be -- chambers --.
Line 64, delete "of".

Signed and Sealed this

Fifteenth Day of March, 2005

JON W. DUDAS
*Director of the United States Patent and Trademark Office*